US007055317B2

(12) United States Patent
Knapp et al.

(10) Patent No.: US 7,055,317 B2
(45) Date of Patent: Jun. 6, 2006

(54) HYDRAULIC MODULE

(76) Inventors: Jurgen Michael Knapp, Heinrich-Heine Strasse 10, 93138 Lappersdorf (DE); Robert Geiger, Mettener Strasse 24, 94526 Metten (DE)

( * ) Notice: Subject to any disclaimer, the term of this patent is extended or adjusted under 35 U.S.C. 154(b) by 86 days.

(21) Appl. No.: 10/776,318

(22) Filed: Feb. 12, 2004

(65) Prior Publication Data

US 2004/0168434 A1 Sep. 2, 2004

(30) Foreign Application Priority Data

Feb. 12, 2003 (DE) ..... 103 06 006

(51) Int. Cl.
*F15B 1/26* (2006.01)

(52) U.S. Cl. ..... 60/413; 60/478

(58) Field of Classification Search ..... 60/325, 60/413, 432, 478; 91/432
See application file for complete search history.

(56) References Cited

U.S. PATENT DOCUMENTS

| | | | | |
|---|---|---|---|---|
| 3,742,713 | A * | 7/1973 | Schweitzer | 60/477 |
| 5,104,294 | A * | 4/1992 | Banba | 60/418 |
| 6,568,919 | B1 * | 5/2003 | Fletcher et al. | 417/307 |
| 6,592,336 | B1 * | 7/2003 | Hirano et al. | 417/201 |
| 6,786,709 | B1 * | 9/2004 | Klahm et al. | 418/39 |
| 2003/0131893 | A1 * | 7/2003 | Ibatici | 137/596.12 |

* cited by examiner

*Primary Examiner*—Thomas E. Lazo
(74) *Attorney, Agent, or Firm*—Hoffman, Wasson & Gitler

(57) ABSTRACT

The invention relates to a new type of hydraulic module for actuating at least one hydraulic control element with a hydraulic pump in a housing, with an electric motor fastened to a first housing side for driving the pump, with a tank located on a second housing side opposite the first side for a hydraulic fluid, e.g. hydraulic oil, with flow channels produced in the housing produced preferably by bore holes for the hydraulic fluid to supply this fluid from the tank to a pump chamber, for transmitting the hydraulic fluid conveyed by the pump to a pressure connection located on the housing, for connection of the at least one actuating element and for returning the hydraulic fluid from the pressure connection into the tank.

22 Claims, 3 Drawing Sheets

HYDRAULIC MODULE

BACKGROUND OF THE INVENTION

An object of the invention is to present a hydraulic module that can be used, for example, in motor vehicles, but also in other areas, as a drive or actuator for functional elements, in particular, wherever there is a requirement for high power in a small design.

An object of the invention is also to present a hydraulic module with a very small design, and which, together with the at least one actuated control element, or actuator, forms a hydraulic system that is fully enclosed from the outside and requires only electric lines for power supply and/or actuation.

SUMMARY OF THE INVENTION

"Hydraulic module", in accordance with the invention, refers to a hydraulic unit with a very compact design. "Pressure regulating shut-off valve", in accordance with the invention, is a valve that can be electrically actuated between a non-blocking and a blocking position and simultaneously functions as a pressure regulating valve in the blocking position, whereby the value of the pressure regulated with this valve can be regulated, or controlled, by the degree of activation, i.e., for example, by the current flowing through an electric or magnetic operating element. This makes it possible not only to adapt the maximum pressure at the pressure connection or output, which allows universal application of the hydraulic module, but also enables regulation of the pressure during the actuating movement of the control element actuated with the hydraulic module according to a specified program or profile.

The hydraulic module according to the invention features a design that is fully enclosed or encapsulated from the outside, so that this module will operate trouble-free even in rough environments.

BRIEF DESCRIPTION OF THE DRAWINGS

The invention is described in more detail below based on the drawings of sample embodiments, as follows.

DETAILED DESCRIPTION OF THE INVENTION

Figure 1:
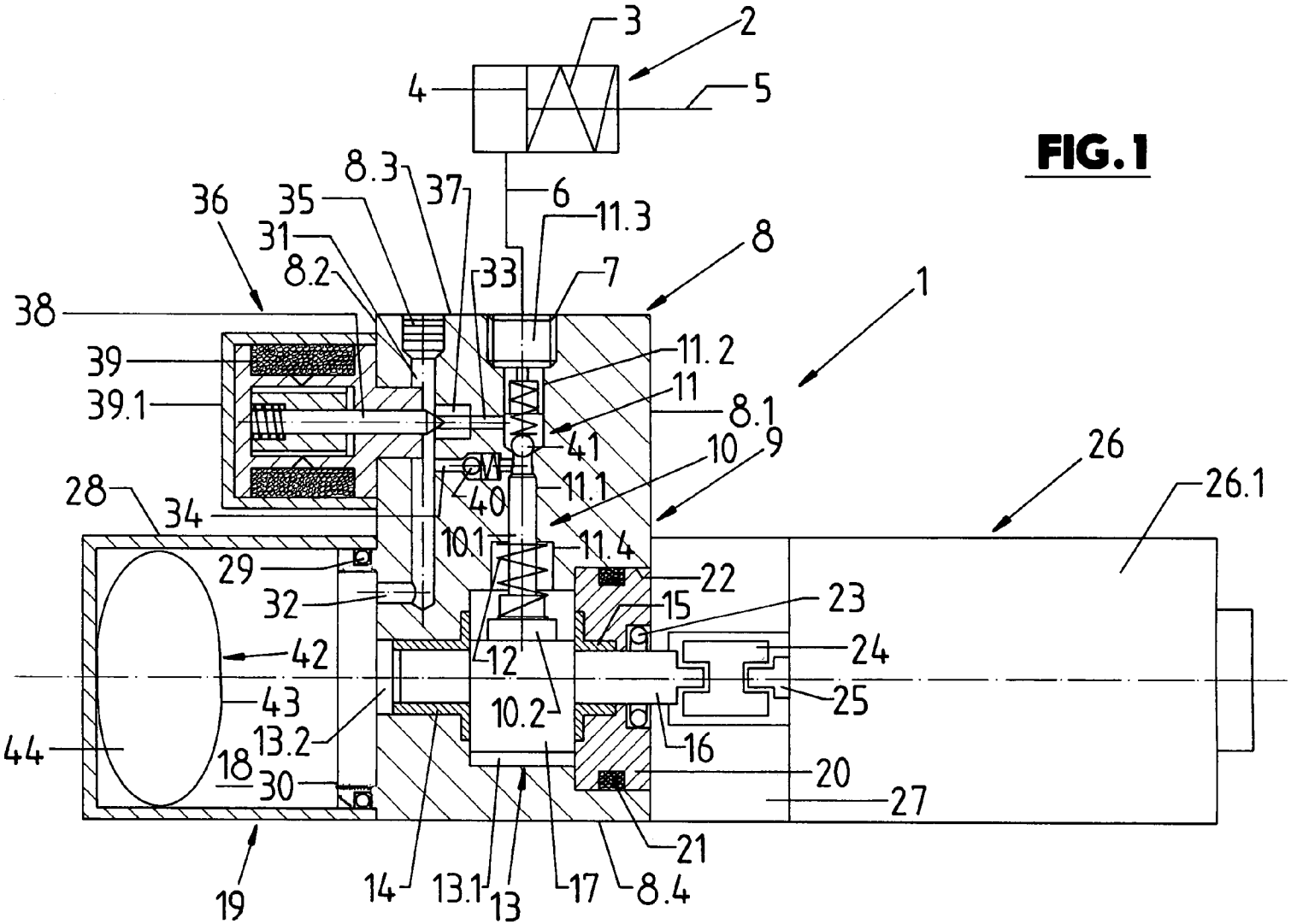
FIG. 1 is a simplified depiction of a partial view of a hydraulic module according to the invention.

The hydraulic module generally designated 1 in FIG. 1 is intended especially, but not exclusively, for use in road vehicles, in particular for the actuation of hydraulic control elements or actuators. In FIG. 1, such an actuating element 2 is depicted by way of example in the form of a hydraulic cylinder with a pressure or pull-back spring 3 for resetting the cylinder or the piston 4 and the piston rod 5 to a starting position. The actuating element 2 in the depicted embodiment is connected via a hydraulic line 6 with a single pressure connection 7 of the hydraulic module 1. Generally, it is also possible that the actuating element 2 is directly flanged onto the hydraulic unit 1, thus forming one structural unit with the hydraulic module.

The hydraulic module 1 consists essentially of a block 8 made of a suitable material, for example of metal, e.g. steel, forming the housing for a hydraulic pump 9, which has a single movable piston 10.

The piston 10, which is formed by a bolt or tappet 10.1, can move axially in a section 11.1 of a hole 11 in the block 8, against the effect or force of a pull-back spring 12, which encloses the tappet 10.1 forming the piston 10 and pretensions the piston in the depiction selected for FIG. 1 in a bottom stroke position. The section 11.1 forms the cylinder space of the piston pump 9.

Above the piston 10 or the piston surfaces, the bore hole 11 continues in a section 11.2 with an enlarged diameter in comparison with the section 11.1 and in a section 11.3 connecting to the section 11.2, which (section 11.3) has an enlarged diameter in comparison with the section 11.2, forming the connection 7 and for this purpose is provided with suitable internal threads for screwing in a nipple of the hydraulic line 6.

Below the section 11.3 the borehole forms a section 11.4 with an enlarged diameter, which leads into an interior space 13 of the block 8. In this interior space 13, a shaft 16 is mounted on bearings at both ends by means of bearings 14 and 15 and has a cam 17 between its two ends or between the bearings 14 and 15.

As depicted, the interior space 13 that is closed toward the outside has two sections, namely section 13.1 with an enlarged diameter, in which also the cam 17 is accommodated and the section 13.2, in which the bearing 14 for the left end of the shaft 16 is located in FIG. 1 and which is open at this end of the shaft 16 and leads into the interior 18 of a tank 19 for a hydraulic fluid, e.g. hydraulic oil.

The other end of the shaft 16 is mounted on bearings by means of the bearing 15 in a circular disk-shaped cover, which tightly seals the interior 13 on this side by means of a sealing ring 21 and is accommodated in a recess 22 of the block 8 such that the side of the cover 20 facing away from the interior 13 is in alignment with the flat side surface 8.2 of the housing 8. The right end of the shaft 16 in FIG. 1 extends with a seal through the cover 20 using a seal 23. This end is connected via a coupler 24 with the shaft 25 of an electric motor 26 for driving the shaft 16. The coupler 24 is located in a housing element 27, which is flanged onto the side surface 8.1 of the block 8 and on which also the electric motor 26 is fastened by means of flanging.

The tank 19 and its interior 18 are formed by a cup-shaped housing 28, which in the depicted embodiment has a hollow cylinder-shaped circumference and a closed bottom. The housing 28 is fastened tightly with its open side using a sealing ring 29 to a ring-shaped projection or flange 30, for example by means of pressing. The projection 30 is located on the side surface 8.2 opposite the side surface 8.1 and concentrically encloses in this embodiment the common axis of the shaft 16 and of the electric motor 26, so that the electric motor 26 with the coupler 24 and the tank 19 are located on opposite parallel side surfaces 8.1 and 8.2 of the block 8.

As FIG. 1 further shows, the axis of the bore hole 11, which is open on the top side 8.3 of the block 8 at section 11.3 or on the connection 7 there, is radial to the longitudinal axis L.

The tappet end 10.2 with the enlarged diameter works together with the cam 17. The pressure spring 12 is also supported on one end against this end 10.2. The other end of the pressure spring 12, i.e. the top end in the depiction in FIG. 1, fits against the shoulder formed by the transition between the sections 11.1 and 11.4.

In block 8, several flow channels 31–34 are formed by bore holes, namely the flow channel 31, which in the depicted embodiment is parallel to the bore hole 11 and is closed at the upper end in FIG. 1 in the area of the top side 8.2 by means of a seal 35 and leads with its lower end in FIG. 1 via a channel 32 into the interior 18 of the tank.

Two parallel flow channels 33 and 34 lead into the flow channel 31, of which the flow channel 33 leads with its other end into the section 11.1 of the bore hole 11, i.e. into the cylinder space of the piston pump 9, and the channel 34 leads with its other end into the section 11.2 of the bore hole 11. At the transition between the channel 31 and the channel 33 there is a controllable valve 36, which consists of a valve seat 37 and a tappet 38 that works together with the latter. The tappet 38 can be moved, by means of an electric actuating element 39, which in the depicted embodiment is an electromagnet located on the side surface 8.2, to a position blocking the valve 36, whereby the blocking effect of the valve 36 or the force with which the valve tappet 38 presses against the valve seat 37 can be adjusted by controlling or regulating the flow through the magnet coil of the actuating element 39. The valve 36 is furthermore designed so that it opens when the actuating device 39 is not activated.

In the channel 34 there is a check or non-return valve 40, which opens for the flow of the hydraulic fluid from the channel 31 into the section 11.1 or into the cylinder space of the piston pump 9 and closes for the flow in the opposite direction. A further a check or non-return valve 41 is located at the transition between the section 11.1 and the section 11.2, i.e. between the openings of the channels 33 and 34 into the bore hole 11. This non-return valve 41 opens for the flow of the hydraulic fluid from the cylinder space of the piston pump 9 into the section 11.2.

In order to ensure the correct operation of the hydraulic module 1 in any installation and any orientation, there is a compensating and pressure element 42 in the tank interior 18 to keep the hydraulic fluid in the tank interior 18, and when the hydraulic module 1 is not activated also in the entire system including the connected actuating element 2, at a specified primary pressure, so that especially also the piston pump 9 with only one piston functions reliably in any state and orientation of the hydraulic module 1 and so that no air or gas bubbles can form in the system. The interior 13 is also completely filled with the hydraulic fluid when the hydraulic module 1 is in working order. The compensating and pressure element 42 consists in the depicted embodiment of a gastight covering 43, which is made of a flexible and/or elastic material and seals off an interior space 44. The interior space 44 is filled with a gas, for example with air or nitrogen, and is under pressure at least when the hydraulic module 1 is operable.

Figure 2:
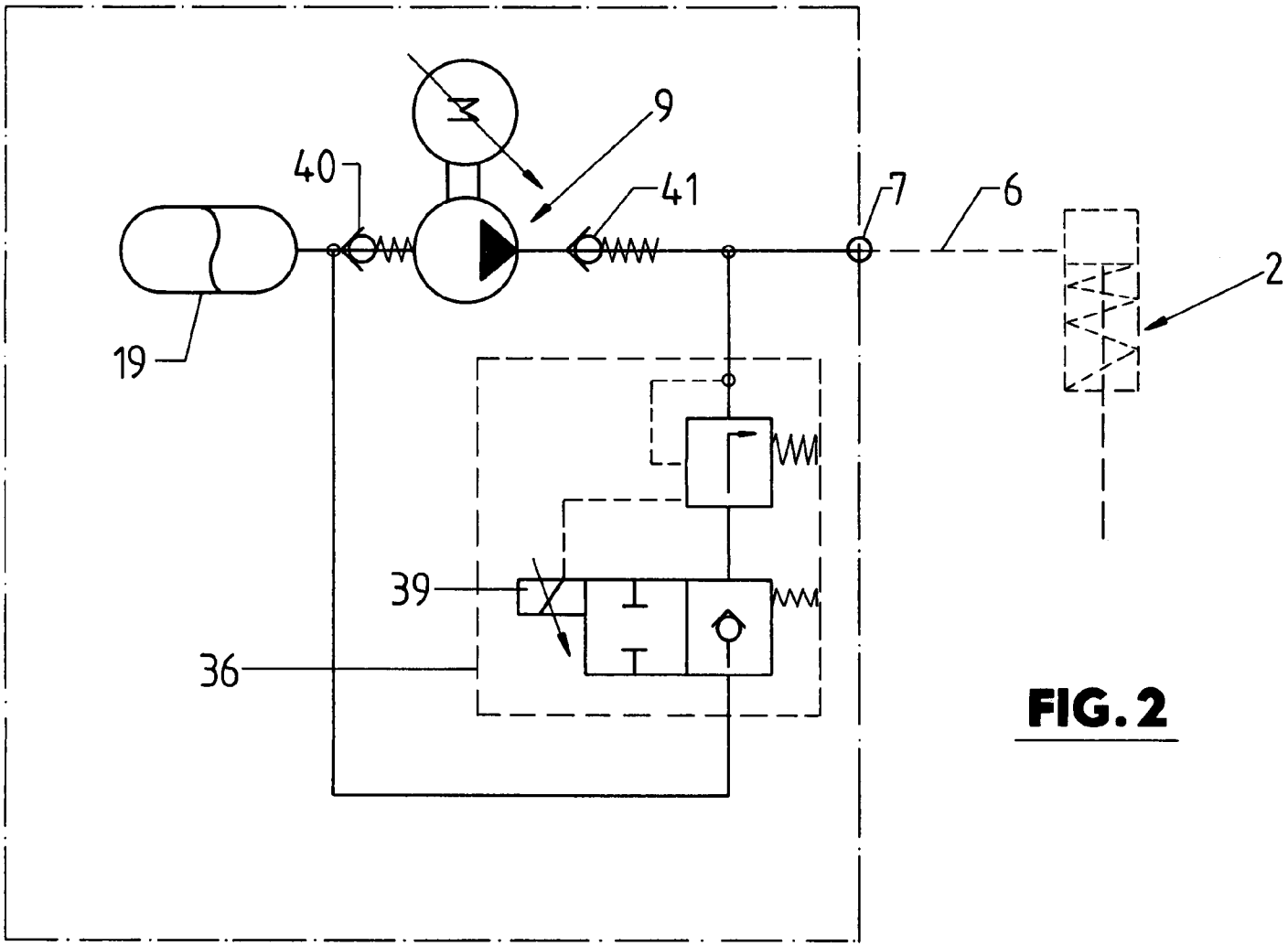
FIG. 2 is a simplified functional depiction of the module of FIG. 1.

The functioning principle of the hydraulic module 1 can be described as follows, taking into account the block-wiring diagram in FIG. 2:

In order to actuate the control element 2, i.e. to move this actuator from its starting position, the electric motor 26 and, simultaneously or afterwards, the actuating device 39 are activated. The piston pump 9 supplies the hydraulic fluid under pressure via the channel formed by the sections 11.2 and 11.3 to the actuating element 2 when the valve is closed, thus actuating the actuator 2. The pressure of the compensating and pressure element 42 causes the hydraulic fluid to flow from the tank interior 18 via the channels 32, 31, 34 and the non-return valve 40 to the cylinder (section 11.1) of the piston pump 9.

By adjusting the flow through the coil of the actuating device 39, the force with which the tappet 38 presses against the valve seat 37 and therefore the pressure at which the valve 36 opens can be adjusted, for the return of the hydraulic fluid from the section 11.2 to the tank interior 18. The valve 36 therefore functions as a controllable pressure-regulating valve.

In order to return the actuator 2 to its starting position, first the motor 36 for example is switched off and then the actuating element 39 of the valve 36 is deactivated, so that the valve 36 opens and the hydraulic fluid can flow back from the actuator 2 via the opened valve 36 and the corresponding flow channels 33, 31 and 32 into the tank interior 18, in the depicted embodiment under the force of the pull-back or pressure spring 3.

The fact that the interior 13 is connected with the tank interior 18 via the gap of the bearing 14 results in lubrication of the bearings 14 and 15. At the same time, hydraulic fluid flowing from the interior 13 can flow back into the tank interior 18 via leaks from the piston 10 to the interior 13.

As depicted, the hydraulic module 1 has a very compact design with small dimensions, whereby the housing 26.1 of the motor 26, the housing of the coupler 27 and also the housing 28 of the tank 19 all have a regular cylindrical shape with the same outer diameter and are arranged on the same axis. The block 8 is for example rectangular, such that its flat bottom side 8.4 is tangentially on one plane with the peripheral surface of the housings 26.1, 27 and 28 and in the direction perpendicular to the plane of projection has a width that is approximately the same as the outer diameter of these housings. Only part of the height of the block 8 extends beyond the top side of the housings 26.1, 27 and 28 in FIG. 1.

Before operating the hydraulic module 1 and the actuator 2 controlled with this module, the system must be filled with the hydraulic fluid, for example via the removable seal 35. Before filling the system, the pressure in the interior 44 is for example the same as the atmospheric pressure.

The overall system is then filled at a specified primary pressure, de-aerating all spaces and flow channels, so that after the system is filled the pressure and compensating element 42 produces the necessary primary pressure for operation in the tank interior 18 and in the spaces or channels connected with this interior, whereby this primary pressure is, of course, much lower than the hydraulic pressure produced by the piston pump 9 when the valve 36 is closed.

The use of the housings 26.1, 27 and 28 and also of a cup-shaped housing 39.1 for the actuating element 39 gives the hydraulic module 1*a* fully encapsulated design.

Figure 3:
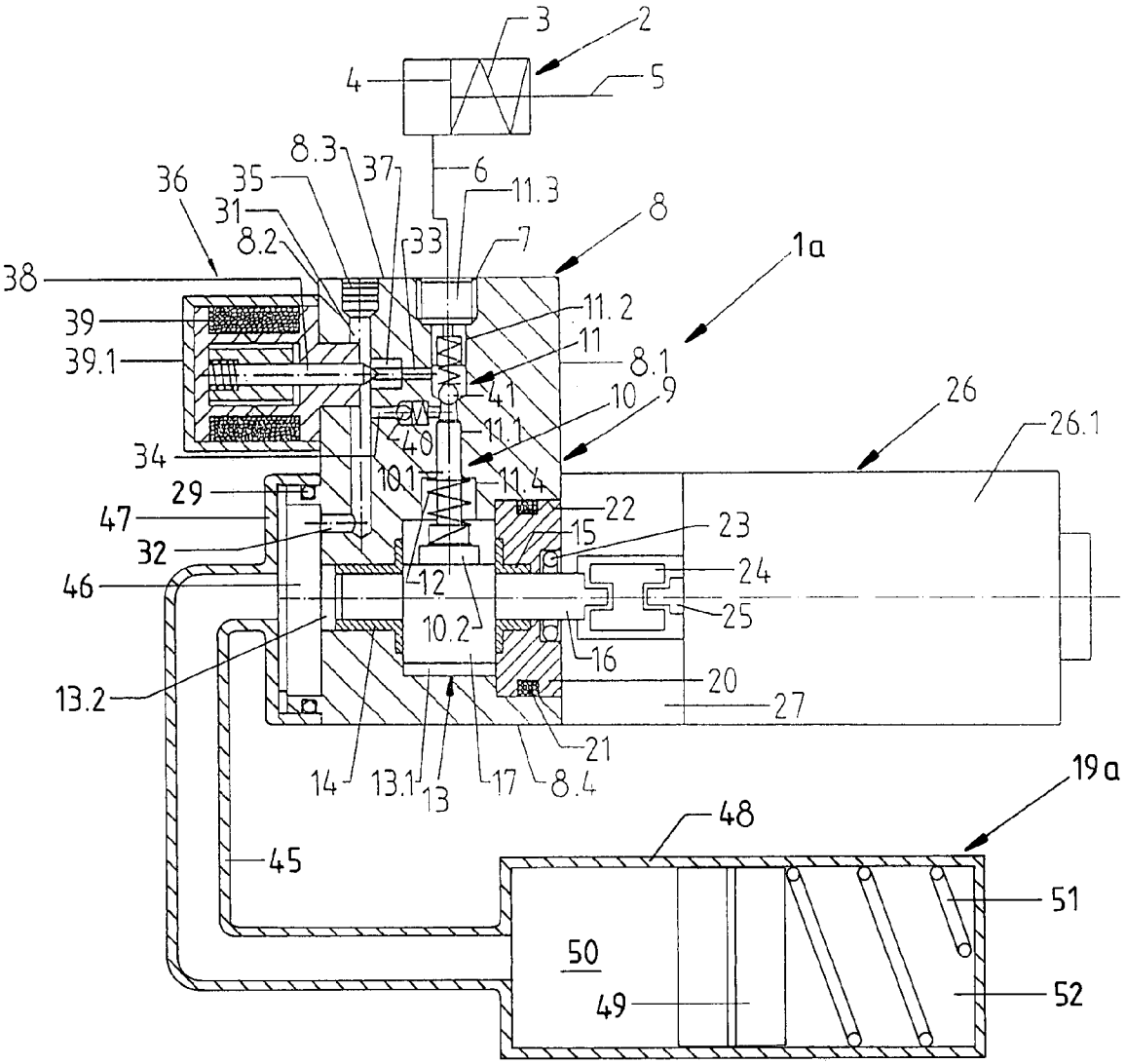
FIG. 3 is a depiction similar to FIG. 1 of an alternate embodiment of the invention.

FIG. 3 shows as a further possible embodiment a hydraulic module 1*a*, which differs from the hydraulic module 1 essentially only in the fact that instead of the tank 19 on the block 8, there is a tank 19*a*, which is connected via a hydraulic line 45 with a space 46 located in the block 8. This space 46 is closed toward the outside by a coupler plate or cap 47, which in the same manner as the tank housing 28 is attached to a flange of the block 8 and sealed by means of the seal 29, such that it overlaps the flange. Both the hydraulic line 45 and the channel 32 lead into the space 46. Furthermore, the section 13.2 of the interior 13 also leads into the space 46.

The tank 19*a* is formed by a closed tank body 48 with a compensating and pressure element 49, which limits on one side the tank interior 50 with variable volume that is connected with the hydraulic line 45. In the depicted embodiment, the tank body 48 is a cylinder body, in which the compensating element 49 designed as a piston can move axially, when enlarging the volume of the tank interior 50 against the effect of a spring force, which for example is provided by a mechanical spring 51 and/or by the fact that the space 52 formed on the other side of the compensating element 49 in the tank body 48 is pressurized with a pressurized gas, for example with pressurized nitrogen.

The invention was described above based on a sample embodiment. It goes without saying that further modifications and variations are possible. For example, it is also possible that the tank 19*a* has a ring-shaped design, e.g. enclosing the electric motor 26, whereby the piston serving as a compensating element 49 then also has a ring-shaped design.

REFERENCE LIST

1 hydraulic module
2 control element or actuator
3 pressure or pull-back spring
4 piston of actuator
5 piston rod of actuator
6 hydraulic line
7 connection
8 block
8.1, 8.2 side surface of block 8
8.3 top of block
8.4 bottom of block
9 piston pump
10 piston
10.1 bolt or tappet
10.2 bolt section or tappet section
11 bore hole
11.1–11.4 bore hole section
12 spring
13 interior
13.1, 13.2 section of interior
14, 15 bearing for shaft 16
16 shaft
17 cam
18 interior of tank
19 tank
20 cover
21 seal
22 recess for cover 20
23 seal
24 coupler
25 motor shaft
26 electric motor
26.1 motor housing
27 housing for coupler 24
28 tank housing
29 seal
30 ring-shaped section or flange
31–34 flow channel
35 seal
36 controllable or variable valve
37 valve seat
38 tappet
39 control element
39.1 housing
40, 41 non-return valve
42 compensating and pressure element
43 covering
44 interior of covering 43
45 hydraulic line
46 space
47 end element or end cap
48 body of tank
49 compensating element in body of tank
50 interior of tank
51 spring element
52 space for holding pressure medium

What is claimed is:

1. A hydraulic module for actuating at least one hydraulic control element or actuator with a hydraulic pump in a housing, with an electric motor fastened to a first housing side for driving the pump, with a tank located on a second housing side opposite the first side for a hydraulic fluid, with flow channels in the housing produced by bore holes for the hydraulic fluid to supply this fluid from the tank to a pump chamber, for transmitting the hydraulic fluid conveyed by the pump to a pressure connection located on the housing for connection of the at least one actuating element and for returning the hydraulic fluid from the pressure connection into the tank, wherein in the flow channel for returning the hydraulic fluid into the tank there is an electrically controllable or adjustable valve, which is a pressure regulating shut-off valve with a valve seat and a tappet cooperating with the valve seat, an electrical actuating device for the tappet controlling the force with which the tappet is pressed against the valve seat and the pressure at which the valve opens, the force at which the valve opens being adjustable by adjusting the actuating device.

2. The hydraulic module as claimed in claim 1, wherein the bellow-like element is a closed covering made of a flexible and/or foldable material.

3. The hydraulic module as claimed in claim 1, wherein the pressure regulating shut-off valve opens in non-activated condition.

4. A hydraulic module for actuating at least one hydraulic control element or actuator with a hydraulic pump in a housing, with an electric motor fastened to a first housing side for driving the pump, with a tank located on a second housing side opposite the first side for a hydraulic fluid, with flow channels in the housing produced by bore holes for the hydraulic fluid to supply this fluid from the tank to a pump chamber, for transmitting the hydraulic fluid conveyed by the pump to a pressure connection located on the housing for connection of the at least one actuating element and for returning the hydraulic fluid from the pressure connection into the tank, wherein in the flow channel for returning the hydraulic fluid into the tank there is an electrically controllable or adjustable valve, which is a pressure regulating shut-off valve, wherein the tank has a compensating and pressure element producing a primary pressure for the hydraulic fluid.

5. A hydraulic module for actuating at least one hydraulic control element or actuator with a hydraulic pump in a housing, with an electric motor fastened to a first housing side for driving the pump, with a tank located on a second housing side opposite the first side for a hydraulic fluid, with flow channels in the housing produced by bore holes for the hydraulic fluid to supply this fluid from the tank to a pump chamber, for transmitting the hydraulic fluid conveyed by the pump to a pressure connection located on the housing for connection of the at least one actuating element and for returning the hydraulic fluid from the pressure connection into the tank, wherein the tank has a compensating and pressure element producing a primary pressure for the hydraulic fluid.

6. The hydraulic module as claimed in claim 5, wherein the flow channel for returning the hydraulic fluid into the tank there is a controllable or adjustable valve, which is designed as a pressure regulating shut-off valve.

7. The hydraulic module as claimed in claim 5, wherein the compensating and pressure element has a wall that at least partially limits the interior of the tank and that is pressurized with a primary pressure on a side facing away from the interior of the tank.

8. The hydraulic module as claimed in claim 5, wherein in the interior of the tank, as a compensating and pressure element, there is a bellow-like element, of which the enclosed interior is filled with a compressible medium.

9. The hydraulic module as claimed in claim 5, wherein the compensating and pressure element is a piston.

10. The hydraulic module as claimed in claim 9, wherein the compensating and pressure element is a ring piston.

11. The hydraulic module as claimed in claim 5, wherein the compensating and pressure element for producing the primary pressure is pressurized with at least one pressure-producing means, for example with at least one mechanical spring element and/or with a gaseous medium under pressure.

12. The hydraulic module as claimed in claim 5, wherein the pump is a piston pump with a single piston.

13. The hydraulic module as claimed in claim 5, wherein the flow channel for supplying the hydraulic fluid to a pump there is a first non-return valve, which opens in the direction of flow from the tank to the pump or the pump chamber and closes in the opposite direction.

14. The hydraulic module as claimed in claim 5, wherein the flow channel between the pump and the at least one pressure connection there is a second non-return valve, which opens in the direction of flow from the pump to the pressure connection and closes in the opposite direction.

15. The hydraulic module as claimed in claim 5, wherein the connection of the flow channel for the return flow is located before the second non-return valve starting from the pressure connection.

16. The hydraulic module as claimed in claim 5, wherein in an interior space of the housing, a shaft coupled with the electric motor for driving the pump is mounted on bearings and that this interior space is connected with the interior of the tank.

17. The hydraulic module as claimed in claim 16, wherein the interior space is directly connected with the interior of the tank.

18. The hydraulic module as claimed in claim 16, wherein the interior space is connected with the interior of the tank by means of a hydraulic connection.

19. The hydraulic module as claimed in claim 5, wherein the flow channel for the return flow and also the valve of the second side surface provided for this flow channel is located adjacent to each other.

20. The hydraulic module as claimed in claim 5, wherein the housing is formed from a block, a rectangular block made of metal.

21. The hydraulic module as claimed in claim 5, wherein the tank is flanged onto a block or housing of the hydraulic module.

22. The hydraulic module as claimed in claim 5, wherein the tank is connected via a hydraulic connection with a space in the housing.

* * * * *